United States Patent [19]

Hayashi et al.

[11] Patent Number: 4,686,547

[45] Date of Patent: Aug. 11, 1987

[54] HEAT-SENSITIVE RECORDING MATERIAL

[75] Inventors: Takayuki Hayashi; Toshimasa Usami; Toshiharu Tanaka, all of Shizuoka, Japan

[73] Assignee: Fuji Photo Film Co., Ltd., Kanagawa, Japan

[21] Appl. No.: 871,350

[22] Filed: Jun. 6, 1986

[30] Foreign Application Priority Data

Jun. 6, 1985 [JP] Japan ..... 60-123166

[51] Int. Cl.[4] ..... B41M 5/18

[52] U.S. Cl. ..... 503/207; 503/202; 503/214; 503/215; 503/216; 503/217; 503/218; 503/226; 427/152

[58] Field of Search ..... 346/200, 226, 202, 207, 346/209, 214–218, 225; 427/150–152

[56] References Cited

FOREIGN PATENT DOCUMENTS 0115391 7/1982 Japan ..... 346/200

0193189 11/1983 Japan ..... 346/226

*Primary Examiner*—Bruce H. Hess

*Attorney, Agent, or Firm*—Sughrue, Mion, Zinn, Macpeak & Seas

[57] ABSTRACT

A heat-sensitive recording material comprising a support having provided thereon a heat-sensitive recording layer, the heat-sensitive recording layer containing a diazo compound encapsulated in microcapsules and a component capable of undergoing a color forming reaction with said diazo compound, wherein a protective coating layer containing as a binder a modified polyvinyl alcohol containing silicon atoms, and at least one of colloidal silica and amorphous silica is applied on the surface of the heat-sensitive recording layer.

15 Claims, No Drawings

HEAT-SENSITIVE RECORDING MATERIAL

FIELD OF THE INVENTION

The present invention relates to a heat-sensitive recording material on which letters or images are recorded by a thermal pen, a thermal head or the like. More particularly, the present invention relates to a light-fixable diazo heat-sensitive recording material, especially to a heat-sensitive recording material which is free from the peeling of the coat and blocking caused by the attachment of water to the heat-sensitive recording layer and is less subject to sticking and stain in the thermal head.

BACKGROUND OF THE INVENTION

Recording materials used in the heat-sensitive recording process include a leuco coloring type heat-sensitive recording material which is commonly used. However, such a heat-sensitive recording material is disadvantageous in that it is subject to undesirable decoloring or color development when handled roughly after recording or brought into contact with an adhesive tape or diazo copying paper.

In order to develop a heat-sensitive recording material free from such a defect, diazo coloring type heat-sensitive recording materials have been intensively studied in recent years. However, diazo compounds are inherently unstable and, therefore, often develop colors on exposed portions thereof under various conditions.

A process is known which comprises thermally recording letters or images on a light- and heat-sensitive recording material comprislng a diazo compound, a coupling component and an alkali producing agent or a color development assistant, and then irradiating the recording material with light to decompose the unreacted diazo compound so that the color development is interrupted, as disclosed in Japanese patent application (OPI) Nos. 123089/82 and 125092/82 (corresponding to U.S. Pat. No. 4,411,979) (the term "OPI" as used herein refers to a "published unexamined Japanese patent application"). However, such a recording material is disadvantageous in that it is subject to gradual precoupling during storage which may cause undesirable coloring (fog). In this respect, Japanese patent application (OPI) No. 190886/84 proposes incorporating at least one of a diazo compound, a coupling component and a color development assistant into the core of a microcapsule.

A light-fixable light-sensitive recording material utilizing such a microcapsule is advantageous in that it needs only a simple recording apparatus and is excellent in shelf life stability and stability of images and background after recording.

However, the heat-sensitive recording material utilizing the permeability of the wall of such a microcapsule caused by heating is disadvantageous in that when water attaches to the recording layer, the heat-sensitive layer may be peeled off, or when its recording material is printed by a thermal head, sticking, stains in the thermal head or other troubles may be caused. In order to improve such a heat-sensitive recording material, a protective layer is provided on the heat-sensitive layer.

Examples of such a heat-sensitive recording paper with an outer protective layer having improved water resistance and exhibiting neither sticking nor stains in the thermal head include those containing a hydrophobic high molecular weight compound or various water-soluble high molecular weight compound and optionally containing a waterproofing agent or a filler as proposed in Japanese Patent Publication No. 27880/69 (corresponding to U.S. Pat. No. 3,445,261) and Japanese patent application (OPI) Nos. 30437/73, 31958/73, 19840/78, 14751/79, 53545/79, 111837/79, 128349/79, 126193/81, 139993/81, 10530/82, (corresponding to U.S. Pat. No. 4,346,343), 29491/82, 1053925/82, 115391/82 (corresponding to U.S. Pat. No. 4,415,627), 144793/82 (corresponding to U.S. Pat. Nos. 4,444,819 and 4,551,738), 107884/82, 53484/83 and 193189/83.

However, these approaches are disadvantageous in that the water resistance of the recording material thus obtained is still insufficient, such exhibit low sensitivity, the antisticking property of the recording material thus obtained is insufficient, the recording material thus obtained develops blocking, and such require a complicated production process, resulting in high production costs. Thus, in general, these approaches are not industrially practical.

SUMMARY OF THE INVENTION

It is, therefore, an object of the present invention to provide a heat-sensitive recording material which is free from the peeling of the heat-sensitive layer possibly caused by the attachment of water to the heat-sensitive layer.

It is another object of the present invention to provide a heat-sensitive recording material which exhibits neither sticking nor stains in the thermal head.

These objects of the present invention can be accomplished by a heat-sensitive recording material comprising a heat-sensitive recording layer formed on a support, the heat-sensitive recording layer containing a diazo compound encapsulated in microcapsules and a component capable of undergoing a color-forming reaction with the diazo compound, wherein a protective coating layer containing as a binder a modified polyvinyl alcohol containing silicon atoms, and at least one of colloidal silica and amorphous silica is applied on the surface of the heat-sensitive recording layer.

These and other objects of the present invention will become more apparent from the following detailed description and examples.

DETAILED DESCRIPTION OF THE INVENTION

The modified polyvinyl alcohol containing silicon atoms which is used in the present invention is not specifically limited if it contains silicon atoms in the molecule. However, modified polyvinyl alcohols containing silicon atoms having reactive substituents such as an alkoxyl group, an acyloxyl group, a hydroxyl group obtained by, e.g., hydrolysis, or an alkali metal base thereof, are preferred.

Processes for the preparation of such a modified polyvinyl alcohol having silicon atoms are described in detail in Japanese patent application (OPI) No. 193189/83. The modified polyvinyl alcohol containing silicon atoms to be used in the present invention can be prepared by these known processes.

An outline of these known processes is described hereinafter. However, the process for the preparation of the modified polyvinyl alcohol to be used in the present invention is not limited to those described in the above-mentioned Japanese patent application (OPI) No. 193189/83. Thus, the modified polyvinyl alcohol to be used in the present invention may be prepared by other known processes.

Japanese patent application (OPI) No. 193189/83 discloses:

(a) A process which comprises incorporating silicon atoms into a polyvinyl alcohol or a modified polyvinyl acetate containing carboxyl groups or hydroxyl groups by post-conversion using a silylating agent.

(b) A process which comprises saponifying a copolymer of a vinyl ester and an olefinic unsaturated monomer containing silicon atoms.

Process (a) may be effected, for example, as follows: A silylating agent is dissolved in an organic solvent which is not reactive with the silylating agent. A polyvinyl alcohol or a modififed polyvinyl acetate containing carboxyl groups or hydroxyl groups is suspended in the resulting solution. The suspension thus obtained is heated from room temperature to the boiling point of the silylating agent so that the polyvinyl alcohol or the modified polvvinyl acetate is allowed to react with the silylating agent. Alternatively, the vinyl acetate is saponified in the presence of an alkali catalyst. Thus, a modified polyvinyl alcohol containing silicon atoms is obtained.

Examples of the silylating agent to be used in this process include an organohalogenosilane, an organosilicone ester, an organolkoxysilane, an organosilranole, an aminoalkylsilane, and an organosilicone isocyanate. The proportion of the amount of the silylating agent to be incorporated into the polyvinyl alcohol or modified polyvinyl acetate, i.e., conversion, may be properly adjusted by adjusting the amount of the silylating agent used and the reaction time.

Process (b) may be effected, for example, as follows: A vinyl ester and an olefinic unsaturated monomer containing silicon atoms are copolymerized with each other in an alcohol in the presence of a radical initiator. An alkali or acidic catalyst is added to the resulting alcohol solution containing a copolymer so that the copolymer is saponified. Thus, a modified polyvinyl alcohol containing silicon atoms is obtained.

The vinyl esters which may be used in this process include vinyl acetate and vinyl propionate. For economical reasons, vinyl acetate is preferably used. Examples of the olefinic unsaturated monomers containing silicon atoms which may be used in this process include vinylsilanes of the following general formula (I) and (meth)acrylamide-alkylsilanes of the general formula (II):

$$CH_2{=}CH{-}(CH_2)_n{-}\underset{\underset{R_m^1}{|}}{Si}{-}(R^2)_{3-m} \qquad (I)$$

$$CH_2{=}CR^3{-}\underset{\underset{O}{\|}}{\overset{\overset{R^4}{|}}{C}}N{-}R^5{-}\underset{\underset{R_m^1}{|}}{Si}{-}(R^2)_{3-m} \qquad (II)$$

wherein n is 0 to 4; m represents an integer of 0 to 2; $R^1$ represents a $C_{1-5}$ alkyl group; $R^2$ represents a $C_{1-40}$ alkoxyl group or acyloxyl group which may optionally have substituents containing oxygen atoms; $R^3$ represents a hydrogen atom or a methyl group; and $R^4$ represents a hydrogen atom, a $C_{1-5}$ alkylene group or a divalent organic residual group which has chain carbon atoms mutually bonded by oxygen or nitrogen atoms, provided that if two or more $R^1$ are contained in a monomer, these $R^1$ may be the same or different, and that if two or more $R^2$ are contained in a monomer, these $R^2$ may be the same or different.

Specific examples of the vinylsilanes of the general formula (I) include vinyltrimethoxysilane, vinyltriethoxysilane, vinyltri(β-methoxyethoxy)silane, vinyltriacetoxysilane, allyltrimethoxysilane, allyltriacetoxysilane, vinylmethoxydiacetoxysilane, vinyldimethoxymethylsilane, vinyldimethylethoxysilane, vinylmethyldiacetoxysilane, vinyldimethylacetoxysilane, vinylisobutyldimethoxysilane, vinyltriiospropoxysilane, vinyltributoxysilane, vinyltrihexyloxysilane, vinylmethoxydihexyloxysilane, vinyltrioctyloxysilane, vinyldimethoxyoctyloxysilane, vinylmethoxydioctyloxysilane, vinylmethoxydilauryloxysilane, vinyldimethoxylauryloxysilane, vinylmethoxydioleyloxysilane, vinyldimethoxyoleyloxysilane, and polyethylene glycolated vinylsilanes of the general formula (III):

$$CH_2{=}CH{-}\underset{\underset{R_p^4}{|}}{Si}{-}[(O{-}CH_2CH_2)_x{-}OH]_{3-m} \qquad (III)$$

wherein $R^4$ and p each have the same meaning as $R^1$ and m above, and x is from 1 to 20.

Specific examples of the (meth)acrylamidealkylsilane represented by the general formula (II) include 3-(meth)acrylamide-propyltrimethoxysilane, 3-(meth)acrylamide-propyltriethoxysilane, 3-(meth)acrylamide-propyltri(β-methoxyethoxy)silane, 2-(meth)acrylamide-2-methylpropyltrimethoxysilane, 2-(meth)acrylamide-2-methylethyltrimethoxysilane, N-(2-(meth)acrylamide-ethyl)-aminopropyltrimethoxysilane, 3-(meth)acrylamide-propyltrimethoxysilane, 2-(meth)acrylamideethyltrimethoxysilane, 1-(meth)acrylamide-methyltrimethoxysilane, 3-(meth)acrylamide-propylmethyldimethoxysilane, 3-(meth)acrylamide-propyldimethylmethoxysilane and 3-(N-methyl-(meth)acrylamide)-propyltrimethoxysilane.

In the preparation of the modified polyvinyl alcohol containing silicon atoms to be used in the present invention, the above-mentioned compounds may be used singly or in combination. In the copolymerization of a vinyl ester and an olefinic unsaturated monomer containing silicon atoms, other unsaturated monomers copolymerizable with such unsaturated monomer containing silicon atoms may also be present.

A preferred modified polyvinyl alcohol containing silicon atoms to be used in the present invention among those prepared by the above processes is a saponified product of a copolymer of an olefinic unsaturated monomer containing silicon atoms of the general formula (I) and vinyl acetate, prepared by process (b). In particular, a saponified product of the copolymer of vinyltrimethoxysilane and/or vinyltributoxysilane of the general formula (I) and vinyl acetate is most preferred.

The content of silicon atoms in the modified polyvinyl alcohol thus obtained may be properly selected depending on the proposed usage. The usual content of silicon atoms is about 0.01 to 10 mol%, preferably 0.1 to 2.5 mol% in terms of the amount of the olefinic unsaturated monomer unit containing the silicon atoms.

The polymerization degree of the modified polyvinyl alcohol containing silicon atoms is not specifically limited. However, the usual polymerization degree of the present modified polyvinyl alcohol is in the range of about 250 to 3,000, preferably 300 to 2,000, and more preferably 500 to 2,000. Similarly, the saponification degree of the vinyl acetate unit is not specifically limited. However, vinyl acetate having a saponification degree of 70 to 100 mol% is preferably used.

The colloidal silica and/or amorphous silica to be used with the silicon-containing modified polyvinyl alcohol in the present invention may be those which are industrially available. The colloidal silica is a colloidal solution which comprises ultrafine particles of silicic anhydride dispersed in water as a dispersant. The particles of silicic anhydride are preferred to have a particle size in the range of about 10 to 100 mμ and a specific gravity of about 1.1 to 1.3. In this case, the pH of the colloidal solution is preferably in the range of about 4 to 10.

The amorphous silica to be used in the present invention may be industrially prepared by either a wet process or a vapor phase process. Suitable amorphous silicas have a primary particle size of about 10 to 30 μm, secondary particle size of about 0.5 to 10 μm, oil absorption (determined in accordance with JIS K 5101) of about 150 to 300 ml/100 g, apparent specific gravity (determined in accordance with JIS K 6223) of about 0.1 to 0.3 g/ml, and pH (measured in the form of a 5 wt % suspension) of about 6 to 10.

In order to form a protective layer using the above-mentioned silicon-containing polyvinyl alcohol, and colloidal silica and/or amorphous silica, these components may be mixed in a proper proportion and then coated on a heat-sensitive coloring layer.

The suitable mixing proportion of colloidal silica and/or amorphous silica to silicon-containing polyvinyl alcohol is in the range of about 0.05 to 10 parts by weight, preferably about 0.1 to 5 parts by weight, more preferably 0.2 to 2 parts by weight of the colloidal silica and/or amorphous silica, based on 1 part by weight of the silicon-containing polyvinyl alcohol. The amount of the protective layer to be coated is in the range of about 0.2 to 5.0 g/m$^2$, preferably 0.5 to 3 g/m$^2$.

The less the amount of the protective layer coated is, the more the heat-sensitive layer is subject to peeling caused by water. In contrast, the more the amount of the protective layer coated is, the poorer the heat response of the heat-sensitive color developing layer is. Accordingly, the amount of the protective layer to be coated may be determined depending on specific requirements in balancing these two properties.

A commonly used binder such as polyvinyl alcohol, methyl cellulose, starch, carboxymethyl cellulose, styrene-maleic acid copolymer, diisobutylenemaleic acid copolymer, polyamide resin, and polyacrylamide resin may also be contained in the protective layer in an amount of up to about 20% by weight of the silicon-containing polyvinyl alcohol.

The heat-sensitive color forming layer of the present invention may be obtained by coating paper or a synthetic resin film base with a coating liquid comprising a diazo compound (color former) encapsulated in microcapsules, a developer which reacts with the diazo compound to develop colors, a basic substance which accelerates the color development, an organic and inorganic pigment, a binder, and optionally a metal soap or wax.

The microcapsule of the present invention is not the same as those used in the prior art recording materials which rupture when subjected to heat or pressure so that a reactive substance encapsulated in the core thereof and other reactive substances outside the capsule are brought into contact with each other to cause color development reaction, but rather, allows reactive substances both inside and outside the capsule to permeate the walls thereof upon heating so that they may react with each other.

It has been found that when the color forming component is dissolved in a liquid which is considered an organic solvent in a broad sense, its heat color forming ability and storage stability are both rendered advantageous. However, in order to provide a further sufficient heat color forming ability, it is necessary that the glass transition point of the microcapsule wall should be in the range of about 60° C. to 200° C., preferably in the range of 70° C. to 150° C.

In order to control the inherent glass transition point of the microcapsule wall, the kinds of the materials to be used in the microcapsule wall may be altered. Particularly preferred capsules include polyurea capsules, polyurethane capsules, polyurea-urethane mixed capsules, urea-formaldehyde capsules, gelatin capsules, capsules made of a mixture of polyurea and another finished commercial synthetic resin (e.g., an oil-soluble polymer) encapsulated in the core thereof, capsules made of a mixture of polyurethane and another synthetic resin, polyester capsules, and polyamide capsules.

The preparation of the microcapsule wall of the present invention may be advantageously accomplished by a microencapsulation process which comprises the polymerization of reactants from the inside of oil particles. In other words, capsules suitable as recording materials having uniform particle diameters and excellent shelf life stability can be prepared in a short period of time.

Specific examples of the above process and compounds are described in U.S. Pat. Nos. 3,726,804 and 3,796,669.

In the preparation of the microcapsule of the present invention, a water-soluble high molecular weight compound may be used as a protective colloid. Such water-soluble high molecular weight compounds include water-soluble anionic high molecular weight compounds, nonionic high molecular weight compounds and amphoteric high molecular weight compounds. As such an anionic high molecular weight compound there may be employed either natural or synthetic anionic high molecular weight compounds. Examples of such an anionic high molecular weight compound include those having a $—COO^-$ group an $—SO_3^-$ group or the like. Specific examples of such a natural anionic high molecular weight compound include gum arabic and alginic acid. Examples of semisynthetic anionic high molecular weight compounds indlude carboxymethyl cellulose, phthalated gelatin, sulfonated starch, sulfonated cellulose, and ligninsulfonic acid.

Examples of a synthetic anionic high molecular weight compound include copolymers of maleic anhydride (including hydrolyzed products), polymers and copolymers of acrylic compounds (including methacrylic compounds), polymers and copolymers of vinylbenzenesulfonic compounds, and carboxy-modified polyvinyl alcohols.

Examples of such a nonionic high molecular weight compound include polyvinyl alcohols, hydroxyethyl cellulose, and methyl cellulose.

As the amphoteric high molecular weight compound, gelatin may be used.

These water-soluble high molecular weight compounds may be used in the form of an aqueous solution with a concentration of about 0.01 to 10 wt %. The amount of these water-soluble high molecular weight compounds used is preferably in the range of from about 3 to 20 wt % based on the weight of the core material of the microcapsule.

The diazo compound to be used in the present invention is a diazonium salt of the general formula $ArN_2^+X^-$ (wherein Ar represents a substituted or unsubstituted aromatic group; $N_2^+$ represents a diazonium group; and $X^-$ represents an acid anion) which can undergo a coupling reaction with a coupling component to develop colors or can decompose by light.

Specific examples of the diazonium compound which forms such a diazonium salt include 4-diazo-1-dimethylaminobenzene, 4-diazo-1-diethylaminobenzene, 4-diazo-1-benzoylamino-2,5-diethoxybenzene, 4-diazo-1-morpholinobenzene, and 4-diazo-1,4-methoxybenzoylamino-2,5-diethoxybenzene.

Specific examples of such an acid anion represented by $X^-$ include $C_nF_{2n+1}COO^-$ (n represents an integer of 3 to 9), $C_mF_{2m+1}SO_3^-$ (m represents an integer of 2 to 8),$(C_lF_{2l+1}SO_2)_2CH^-$ (l represents an integer of 1 to 18),

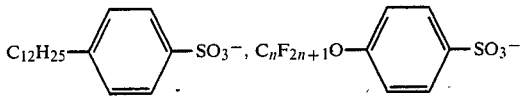

(no represents an integer of 3 to 9), $BF_4^-$, and $PF_6^-$.

Specific examples of such a diazo compound (diazonium salt) include:

D-1

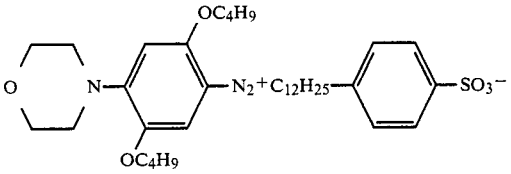

D-2

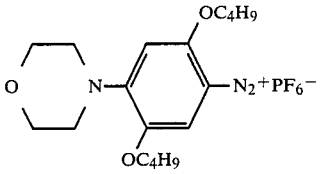

D-3

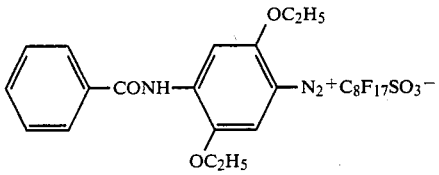

D-4

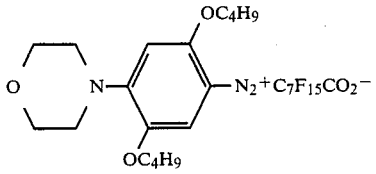

D-5

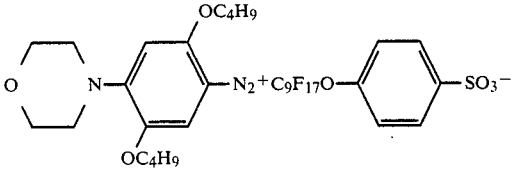

As the developer which reacts with these diazonium salts to form colors there may be employed compounds, i.e., coupling agents, which cause coupling with the diazonium salt usually in a basic environment to form a dye. Specific examples of such a developer include resorcin, phloroglucinol, 2,3-dihydroxynaphthalene-6-sodium sulfonate, 1-hydroxy-2-morpholinopropylamide naphthoate, 2-hydroxy-3-naphthoic acid-N-dodecyloxy-propylamide, 2-hydroxy-3-tetradecylamide naphthoate, acetanilide, acetoacetanilide, benzoylacetanilide, 1-(2', 4', 6'-trichlorophenyl)-3-anilino-5-pyrazolone, and 1-phenyl-3-phenylacetamide-5-pyrazolone. Images with desired color tones can be obtained by using these coupling agents in combination.

In a system using a diazonium salt as a color former, a basic substance may also be used for the purpose of acceleration of color development.

As such a basic substance there may be employed a water-insoluble or nearly water-insoluble basic substance or a substance which produces an alkali under heating.

Examples of such a basic substance include inorganic and orgahic ammonium salts, organic amines, amides, urea and thiourea and derivatives thereof, thiazoles, pyrroles, pyrimidines, piperazines, guanidines, indoles, imidazoles, imidazolines, triazoles, morpholines, piperidines, amidines, formamidines, and pyridines. Specific examples of these basic substances include ammonium acetate, tricyclohexylamine, octadecylbenzylamine, allylurea, thiourea, methylthiourea, 2-benzylimidazole, 2-phenyl-4-methylimidazole, 2-undecylimidazoline, 1,2-phenyl-2-imidazoline, 1,2,3-triphenylguanidine, 1,2-ditolylguanidine, 1,2-dicyclohexylguanidine, guanidine-trichloroacetate, N,N'-dibenzylpiperazine, 4,4'-dithiomorpholine, and 2-aminobenzothiazole. These basic substances may be used in combination.

The coupling agent and the basic substance of the present invention are preferably added in the form of a dispersion of fine particles. The amounts of the coupling agent and the basic substance to be added are preferably about 0.1 to 10 parts by weight and about 0.1 to 20 parts by weight based on 1 part by weight of the diazo compound, respectively. The diazo compound is preferably coated on the support in an amount of about 0.05 to 2.0 $g/m^2$.

The diazonium salt to be used as a color former is microencapsulated in the form of a solution in an organic solvent.

As the organic solvent to be used in the present invention there may be preferably used those having a boiling point of about 180° C. or higher rather than those having a lower boiling point whereby evaporation loss of the solvent during shelf storage may occur. As an organic solvent free of vinyl polymerization there may be used a phosphoric ester, a phthalic ester, other carboxylic esters, an aliphatic amide, an alkylated biphenyl, an alkylated terphenyl, chlorinated paraffin, an alkylated naphthalene, or a diarylethane. Specific examples of such an organic solvent include tricresyl phosphate, trioctyl phosphate, octyldiphenyl phosphate, tricyclohexyl phosphate, dibutyl phthalate, dioctyl phthalate, phthalic laurate, dicyclohexyl phthalate, butyl oleate, diethylene glycol dibenzoate, dioctyl sebacate, dibutyl sebacate, dioctyl adipate, trioctyl trimellitate, acetyl triethyl citrate, octyl maleate, dibutyl maleate, isopropyl biphenyl, isoamyl biphenyl, chlorinated paraffin, diisopropyl naphthalene, 1,1'-ditolylethane (e.g., 1,1'-di-p-tolylethane), 2,4-ditertiary amylphenol, and N,N-dibutyl-2-butoxy-5-tertiary octylaniline.

The coating liquid thus obtained may be applied with a proper binder.

As such a binder there may be employed a compound which can be dissolved in water at a temperature of 25° C. in an amount of 5% or more by weight. Specific examples of such a binder include methyl cellulose, carboxymethyl cellulose, hydroxyethyl cellulose, starch, gelatin, gum arabic, casein, a hydrolyzed product of a styrene-maleic anhydride copolymer, a hydrolyzed product of an ethylene-maleic anhydride copolymer, a hydrolyzed product of an isobutylene-maleic anhydride copolymer, polyvinyl alcohol, and carboxy-modified polyvinyl alcohol.

As an oil-absorbing pigment there may be employed an inorganic pigment such as zinc oxide, calcium carbonate, barium sulfate, titanium oxide, lithopone, talc, agalmatolite, kaolin, aluminum hydroxide, and calcined kaolin, or an organic pigment such as a urea-formaldehyde resin and powdered polyethylene.

As such a metal soap there may be used a higher fatty acid metal salt such as zinc stearate, calcium stearate and aluminum stearate.

As such a wax there may be used a polyethylene wax, a carnauba wax, a paraffin wax, a microcrystalline wax and a fatty amide. These oil-absorbing pigments, metal soaps and waxes may be contained in the heat-sensitive color forming layer and the coated protective layer.

If desired, an antioxidant, an image-storage stability improver or the like may be added to these components.

As such an image-storage stability improver there may be used a phenol which has at least the 2- or 6-position hydrogen substituted by an alkyl group or derivatives thereof. Among these, a phenol which has at least one of its 2- and 6-position hydrogens substituted by a branched alkyl group or a derivative thereof is preferred. Those having a plurality of phenol groups, preferably 2 or 3 phenol groups, are also preferred.

A coating liquid is prepared by mixing microcapsules containing a color developing agent with a solid dispersion or an aqueous solution of other components. The coating liquid thus obtained is applied on a support such as paper and synthetic resin film by a suitable coating process such as bar coating, blade coating, air knife coating, gravure coating, roll coating, spray coating, and dip coating and dried so that a heat-sensitive layer with a solid content of 2.5 to 25 g/m$^2$ results.

As such a support paper there may be used as neutral paper having a heat extraction pH of about 6 to 9, which is sized with a neutral sizing agent such as an alkylketene dimer (as described in Japanese patent application (OPI) No. 14281/80, corresponding to U.S. Pat. No. 4,255,491). Such a paper is advantageous from the viewpoint of the shelf life with the passage of time.

In order to prevent the coating liquid from penetrating into the paper support or improve the contact between the thermal recording head and the heatsensitive recording layer, the present support paper advantageously has the ratio:

$$\frac{\text{Stöckingt Sizing Degree}}{(\text{Metric Weighting Capacity})^2} \geqq 3 \times 10^{-3}$$

and a Beck smoothness of 90 sec. or more, as described in Japanese patent application (OPI) No. 116687/82 (corresponding to U.S. Pat. No. 4,416,939). Other papers which may be used with excellent results include paper with an optical surface roughness of 8 μm or less and a thickness of 40 to 75 μm as described in Japanese patent application (OPI) No. 136492/83; paper with a density of 0.9 g/cm$^3$ or less and an optical contact percentage of 15% or more as described in Japanese patent application (OPI) No. 69091/83; paper free from penetration of a coating liquid made of a pulp having a Canadian standard freeness (JIS P 8121) of 400 cc or more as described in Japanese patent application (OPI) No. 69097/83; paper made by a Yankee paper machine the lustrous surface thereof is used as coating surface for improving color density and resolving power as described in Japanese patent application (OPI) No. 65695/83 (corresponding to U.S. Pat. No. 4,466,007); and paper with an improved coating aptitude achieved by corona discharging treatment as described in Japanese patent application (OPI) No. 35985/84. Besides the above papers, any support usually used in the field of ordinary heatsensitive recording paper may be used in the present invention.

In the preparation of the coating liquid, all the components may be mixed altogether and then crushed. Alternatively, these components may be mixed, in proper combinations, crushed separately and then mixed together.

If paper is used as a support, it is desired for the purposes of curl balance that a thin resin layer is provided on the opposite side of the support from the heat-sensitive color forming layer and the color forming layer.

The present invention will be explained in greater detail with reference to the following examples, but the present invention should not be construed as being limited thereto. In addition, all parts, percents and ratios in these examples, unless otherwise indicated, are by weight.

EXAMPLE 1

Capsules were prepared by using the following diazo compound:

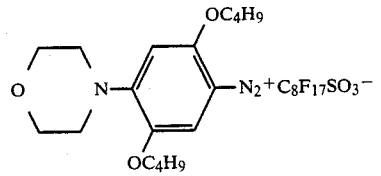

2 Parts of the above diazo compound, 6 parts of an addition product of tolylene diisocyanate and trimethylolpropane in a proportion of 3:1 (molar ratio) and 18 parts of an addition product of xylylene diisocyanate and trimethylolpropane in a proportion of 3:1 (molar ratio) were dissolved into a mixed solvent of 24 parts of dibutyl phthalate and 5 parts of ethyl acetate. The resulting diazo compound solution was admixed with an aqueous solution of 5.0 parts of polyvinyl alcohol dissolved in 58 parts of water so that it was emulsion-dispersed thereinto at a temperature of about 20° C. to obtain an emulsion having an average particle diameter of about 3 μm. 100 Parts of water was added to the emulsion thus obtained. The admixture was heated to a temperature of about 60° C. with stirring. Two hours later, a capsule liquid having the diazo compound contained in the core material thereof was obtained.

20 Parts of 2-hydroxy-3-anilide naphthoate was added to 100 parts of a 5% aqueous solution of polyvinyl alcohol and dispersed thereinto by a sand mill for about 24 hours to obtain a dispersion of a coupling component having an average particle diameter of about 3 μm.

20 Parts of triphenyl guanidine was added to 100 parts of a 5% aqueous solution of polyvinyl alcohol and dispersed thereinto by a sand mill for about 24 hours to obtain a dispersion of triphenyl guanidine having an average particle diameter of about 3 μm. In addition, 20 parts of p-benzyloxy phenol was added to 100 parts of a 5% aqueous solution of polyvinyl alcohol and dispersed thereinto by a sand mill for about 24 hours to obtain a dispersion of p-benzyloxy phenol having an average particle diameter of 3 μm.

15 Parts of calcium carbonate, 25 parts of a 10% aqueous solution of polyvinyl alcohol and 50 parts of water were subjected to dispersion by a ball mill overnight to obtain a dispersion.

50 Parts of the capsule liquid thus obtained, 15 parts of the coupling dispersion thus obtained, 15 parts of the triphenyl guanidine dispersion thus obtained, and 20 parts of the calcium carbonate dispersion thus obtained were mixed with each other. 5 Parts of a 20% zinc stearate dispersion was added to the resulting mixed solution and thoroughly dispersed thereinto to obtain a coating liquid.

The coating liquid thus obtained was applied on a sheet of a fine paper (50 g/m$^2$) by a coating rod in such a manner that the dry weight reached 10 g/m$^2$. The coating liquid thus applied was then dried at a temperature of 45° C. for 30 minutes to obtain a heat-sensitive recording material.

The heat-sensitive color forming layer was coated with a protective coating layer liquid prepared as described hereinafter in such a manner that the solid content reached 2.5 g/m$^2$. The liquid thus applied was then dried at a temperature of 50° C. for 2 minutes to form a protective coating layer. The protective coating layer thus formed was subjected to calendering to obtain a heat-sensitive recording paper of the present invention having a smoothness determined in accordance with JIS P 8119 of 850 seconds.

Preparation of a Protective Coating Layer Liquid

| | |
|---|---|
| 10% Aqueous solution of silicon-modified polyvinyl alcohol* | 70 g |
| 20% Colloidal silica (Snow Tex C, made by Nissan Kagaku Kogyo K. K.) | 20.0 g |
| 50% Kaolin dispersion | 10 g |
| 21% Paraffin wax dispersion (average carbon number: 30) | 2.5 g |
| 30% Zinc stearate dispersion | 1.5 g |

*Copolymer of vinyl trimethoxysilane and vinyl acetate containing silicon atoms in an amount of 0.5 mol % based on the amount of the vinylsilane unit and having a saponification degree of the vinyl acetate unit of 98.3% and a polymerization degree of about 500

These components were mixed with each other to obtain a protective coating layer liquid.

EXAMPLE 2

A heat-sensitive recording paper was obtained in the same manner as used in Example 1 except that the protective coating layer liquid was prepared as follows:

| | |
|---|---|
| 5% Aqueous solution of silicon-modified polyvinyl alcohol* | 50 g |
| 25% Aqueous solution of polyamide | 5 g |
| 20% Calcium-treated amorphous silica (oil absorption determined in accordance with JIS K 5101: 150 ml/100 g) | 10 g |
| 50% Calcium carbonate dispersion | 10 g |
| 30% Zinc stearate dispersion | 1.5 g |
| 20% Amide stearate dispersion | 2.5 g |

*Copolymer of vinyl trimethoxysilane and vinyl acetate containing silicon atoms in an amount of 0.5 mol % based on the amount of the vinylsilane unit and having a saponification degree of the vinyl acetate unit of 98.5% and a polymerization degree of about 1,000

COMPARATIVE EXAMPLE 1

A heat-sensitive recording paper for comparison was obtained in the same manner as used in Example 1 except that no protective coating layer was provided.

COMPARATIVE EXAMPLES 2 TO 4

Heat-sensitive recording papers for comparison were obtained in the same manner as used in Example 1 except that the protective coating layer was formed of the following coating liquids:

Comparative Example 2

A coating liquid made of a 20% colloidal silica dispersion alone was applied in such a manner that the coated amount (solid content) reached 2.5 g/m$^2$.

Comparative Example 3

A coating liquid made of a mixture of 70 g of a 10% aqueous solution of the silicon-modified polyvinyl alcohol and 10 g of a 50% kaolin dispersion used in Example 1 was applied in an amount of 2.5 g/m$^2$ in terms of the solid content.

Comparative Example 4

A coating liquid made of a mixture of 50 g of a 10% aqueous solution of polyvinyl alcohol and 50 g of a 50% kaolin dispersion was applied in an amount of 2.5 g/m$^2$ in terms of the solid content. The heat-sensitive recording papers obtained in the above examples and comparative examples were subjected to the following tests:

(1) Color Forming Property

Recording was effected by a recording element which had been given an energy of 50 mJ/m$^2$. Scanning was effected at a rate of 2 ms/dot with a density of 5 dots/mm (main scan) and 6 dots/mm (subscan). The color density (initial) of the color-developed material after recording was measured by means of a Macbeth RD-514 type reflection densitometer (equipped with a visual filter).

(2) Peeling of the Coating Film due to Attachment of Water 5 ml of water was dropped on the surface of the recording papers. The surface was then rubbed with a finger 10 times to determine the extent of peeling of the coating film on the heat-sensitive layer.

(3) Adaptability to Running through a Heat-Sensitive Facsimile

A heat-sensitive facsimile (Matsushita Denso UF-920) was used to see how the paper is printed and to check for sticking and stains in the thermal head.

The results are shown in Table 1.

TABLE 1

| Example No. | Color Forming Property | Peeling of Coating Film | Sticking | Stain in Head |
|---|---|---|---|---|
| Example 1 | 1.15 | o | o | o |
| Example 2 | 1.13 | o | o | o |
| Comparative Example 1 | 1.18 | x | x | x |
| Comparative Example 2 | 1.05 | Δ | x | Δ |
| Comparative Example 3 | 1.13 | Δ | Δ | Δ |
| Comparative Example 4 | 1.13 | x | Δ | Δ |

o: No practical problems
Δ: Slight practical problems
x: Practically unusable

Table 1 shows that the heat-sensitive recording papers of Examples 1 and 2, though somewhat inferior to those free of a protective coating layer (Comparative Example 1) in color forming property, are excellent in water resistance and show excellent properties for preventing sticking and stains in the thermal head.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a heat-sensitive recording layer, said heat-sensitive recording layer containing a diazo compound encapsulated in microcapsules and a component capable of undergoing a color forming reaction with said diazo compound, wherein a protective coating layer containing as a binder a modified polyvinyl alcohol containing silicon atoms, and at least one of colloidal silica and amorphous silica is applied on the surface of said heat-sensitive recording layer.

2. A heat-sensitive recording material according to claim 1, wherein said diazo compound is a diazonium salt represented by the general formula $ArN_2^+X^-$, wherein Ar represents a substituted or unsubstituted aromatic group, $N_2^+$ represents a diazonium group and $X^-$ represents an acid anion.

3. A heat-sensitive recording material according to claim 1, wherein said component capable of undergoing a color forming reaction with said diazo compound is a developer selected from the group consisting of resorcin, phloroglucinol, 2,3-dihydroxynaphthalene-6-sodium sulfonate, 1-hydroxy-2-morpholinopropylamide naphthoate, 2-hydroxy-3-naphthoic acid-N-dodecyloxy-propylamide, 2-hydroxy-3-tetradecylamide naphthoate, acetanilide, acetoacetanilide, benzoylacetanilide, 1-(2', 4', 6'-trichlorophenyl)-3-anilino-5-pyrazolone, and 1-phenyl-3-phenylacetamide-5-pyrazolone and mixtures thereof.

4. A heat-sensitive recording material according to claim 1, wherein said diazo compound is coated on said support in an amount of about 0.05 to 2.0 g/m$^2$.

5. A heat-sensitive recording material according to claim 1, wherein said component capable of undergoing a color forming reaction with said diazo compound is present in an amount of about 0.1 to 10 parts by weight based on 1 part by weight of said diazo compound.

6. A heat-sensitive recording material according to claim 1, wherein said microcapsules containing said diazo compound comprise permeable outer polymer walls wherein the glass transition point of said polymer walls is in the range of about 60° C. to 200° C.

7. A heat-sensitive recording material according to claim 6, wherein the glass transition point of said microcapsule polymer walls is in the range of 70° C. to 150° C.

8. A heat-sensitive recording material according to claim 1, wherein said modified polyvinyl alcohol containing silicon atoms has reactive substituents.

9. A heat-sensitive recording material according to claim 8, wherein said reactive substituents are selected from the group consisting of an alkoxyl group, an acyloxyl group, a hydroxyl group obtained by hydrolysis, or an alkali metal base thereof.

10. A heat-sensitive recording material according to claim 1, wherein said colloidal silica is a colloidal solution comprising ultrafine particles of silicic anhydride dispersed in water.

11. A heat-sensitive recording material according to claim 10, wherein the size and specific gravity of said particles of silicic anhydride is in the range of about 10 to 100 μ m and in the range of about 1.1 to 1.3, respectively, and the pH of said colloidal solution is in the range of about 4 to 10.

12. A heat-sensitive recording material according to claim 1, wherein said amorphous silicas have a primary particle size of about 10 to 30 μm, a secondary particle size of about 0.5 to 10 μm, an oil absorption of about 150 to 300 ml/100 g, an apparent specific gravity of about 0.1 to 0.3 g/ml and a pH of about 6 to 10.

13. A heat-sensitive recording material according to claim 1, wherein said protective coating layer is formed by mixing said modified polyvinyl alcohol containing silicon atoms, and at least one of colloidal silica and amorphous silica in a proper proportion and then coating the resulting mixture on said heat-sensitive recording layer.

14. A heat-sensitive recording material according to claim 13, wherein said protective coating layer is coated in an amount of about 0.2 to 5.0 g/m$^2$.

15. A heat-sensitive recording material according to claim 14, wherein said protective coating layer is coated in an amount of 0.5 to 3.0 g/m$^2$.

* * * * *